US005972167A

United States Patent [19]

Hayasaka et al.

[11] Patent Number: 5,972,167

[45] Date of Patent: Oct. 26, 1999

[54] TRANSFER ROLL COATING COLOR AND A COATED PAPER

[75] Inventors: Hideki Hayasaka; Osamu Kozuka; Katsuhiko Matsunaga; Hideki Fujiwara, all of Tokyo, Japan

[73] Assignee: Nippon Paper Industries Co., Ltd., Tokyo, Japan

[21] Appl. No.: 08/915,158

[22] Filed: Aug. 20, 1997

Related U.S. Application Data

[63] Continuation-in-part of application No. 08/340,056, Nov. 15, 1994, abandoned.

[30] Foreign Application Priority Data

Nov. 16, 1993 [JP] Japan ..... 5-286313

[51] Int. Cl.[6] ..... B05D 3/12; D21H 17/28

[52] U.S. Cl. ..... 162/135; 162/175; 427/364

[58] Field of Search ..... 427/364; 162/135, 162/175

[56] References Cited

U.S. PATENT DOCUMENTS

| | | | |
|---|---|---|---|
| 3,598,622 | 8/1971 | Maher et al. | 106/210 |
| 4,322,472 | 3/1982 | Kaspar et al. | 428/350 |
| 4,863,543 | 9/1989 | Shiozawa et al. | 156/235 |
| 4,996,184 | 2/1991 | Bevan et al. | 503/226 |
| 5,030,325 | 7/1991 | Saji et al. | 162/135 |
| 5,032,225 | 7/1991 | Saji et al. | 162/135 |

OTHER PUBLICATIONS

Luttgen, Wochenbl. Papierfabr. (Mar. 1991), vol. 119, No. 5, pp. 157–160.

Kasuya, Jpn. Tappi J. (Feb. 1995), vol. 49, No. 2, pp. 170–176.

J.P. Casey, editor, *Pulp and Paper, Chemistry and Chemical Technology,* Third Edition, vol. IV, John Wiley & Sons, pp. 2040–2056, 2080, 2081, 2118, 2119, 2137–2144 (1983).

*Primary Examiner*—Erma Cameron

*Attorney, Agent, or Firm*—Testa, Hurwitz & Thibeault, LLP

[57] ABSTRACT

A transfer roll coating color is described comprising a pigment and an adhesive as main components, wherein the average aspect ratio of the pigment is 10 or less, the adhesive is a low viscosity starch adhesive, the solids content of the color is about 58 weight % or higher, and the viscosity of the color determined at 60 rpm by using a No. 4 rotor of a Brookfield™ viscometer is 1,500 cps or less. Coated papers obtained by transfer roll coating using the colors at an amount of 5 g/m2 or higher per side also are disclosed.

11 Claims, No Drawings

TRANSFER ROLL COATING COLOR AND A COATED PAPER

RELATED APPLICATIONS

The present invention is a continuation-in-part of Ser. No. 08/340,056, filed Nov. 15, 1994, now abandoned the entire disclosure of which is incorporated herein by reference.

FIELD OF INVENTION

The present invention relates to a transfer roll coating color and a method of using it to make high-quality coated paper. More particularly, the present invention relates to a transfer roll coating color comprising a novel composition having a high solids content and low viscosity, with which coating may be carried out without affecting the advantages of transfer roll coating, particularly, stable runnability at high speed. Coated papers made with the present coating have excellent gloss, smoothness and printability, comparable to those obtained by blade coating.

BACKGROUND OF THE INVENTION

Paints or coatings used in conventional transfer roll coatings for coating paper, in which pigments and adhesives are the main components typically are highly viscous compared to other coating colors, and characterized in that coating weights are generally low. Pigments which may be used in a typical formulation include inorganic pigments such as kaolin, clay, precipitated calcium carbonate, ground calcium carbonate, titanium oxide, aluminum hydroxide, satine white, barium sulfate, magnesium oxide, talc and colloidal silica; as well as organic pigments such as plastic pigments and white urea resin pigments, which are generally used in admixture of two kinds or more. Adhesives which may be used include water-soluble polymers such as casein, oxidized starch, phosphoric esterized starch, soybean protein and carboxymethyl cellulose, as well as synthetic rubber latexes such as styrene-butadiene rubber (SBR), methyl butadiene rubber (MBR) or methyl styrene butadiene rubber (MSBR), and acrylic latexes. The adhesives (also referred to as binders) typically are used in an amount of about 10–50 weight % of the water-soluble macromolecule, and 10–30 weight % of the latex, based on 100 weight % of the pigment. Furthermore, additives such as anti-foaming agents, dispersants, water-proofing agents, preservatives, coloring agents or lubricants may be added.

The solids content of the transfer roll coating color is typically about 40–55 weight %, and the ratio between the pigment and the adhesive (pigment:binder ratio) is such that the adhesive is about 30–50 weight % to the pigment, which means that the amount of the adhesive is high. Furthermore, starch adhesives and latex adhesives often are used together and the ratio of the starch adhesive can be as high as 20–50 weight % to the pigment. The starch adhesives generally used have a viscosity of at least 3,000 centipose (cps), generally 10,000 cps or higher, as determined at a solids content of about 30 weight %, a temperature of about 50 ° C. and 60 rpm by means of a No. 4 rotor of a Brookfield™ viscometer. In addition, the amount of coating on one side of the paper generally is less than 5 g/m$^2$, more often less than 3 g/m$^2$, for an effective coating.

Transfer roll coating is known to be suitable for coating sizing liquids onto paper because a light weight coating is obtained. Transfer roll coating of paper has many advantages, such as (1) the device is compact, (2) the coating can be carried out with wide webs, (3) on-machine coating can be carried out, (4) less paper break occurs, (5) a continuous operation is possible for several days, (6) coating on both sides of the paper is easily achieved, and (7) the difference between the front and back surfaces of the product are minimal. However, there are also some disadvantages, such as (1) the feel of the coated surface often is inferior to that obtained by blade coating, (2) the characteristics of the coating may be limited, and (3) maintenance of the transfer rolls is necessary.

The coated surface obtained by transfer roll coating often has a specific stripy coating pattern, and transfer roll coating may not give an even, smooth and glossy coated surface, compared to that which can be obtained with blade coating. The appearance of the stripy pattern can be improved by increasing the coating weight, but a split surface pattern such as orange peel, or an aventurine appearance, may then appear which reduces the quality of printability which can be obtained when the transfer roll coated paper is printed. For these reasons, in spite of its many advantages described above, transfer roll coating has been used only for applying sizing liquid coatings or light weight coatings where a high coated amount is not necessary, or for preparation of a low-grade coated paper where printability is not critical.

There has recently been a market trend toward higher quality coated papers. For example, in art papers, so-called super art papers with more gloss and superior printability have appeared; and papers having higher opacity, stiffness and gloss are required even in the customary grades such as superlight weight coated papers. This tendency toward improved quality is similar in low-grade coated papers. To obtain the requisite improvement in smoothness and gloss of the coated paper, a super calender or a machine calender has hitherto been used, and means such as an increase in the calender pressure and temperature are used to obtain coated papers with higher gloss. However, if these means are applied to transfer roll coated paper, gloss may be improved somewhat, but calipers become short, and qualities such as opacity, whiteness, stiffness and ink acceptability are lowered.

An object of the present invention is to provide a transfer roll coating color with which an even coated surface without any undesirable surface patterns, as well as high-gloss and smooth coated surface can be obtained using low pressure calendering conditions, without affecting any of the advantages of transfer roll coating. These advantages include stable runnability at high speed on machine, and a coated paper product having excellent printability, comparable to coated papers obtained by the blade coating method.

Generally, if the coating weight is increased, a smoother surface can be obtained. The coating weight in transfer roll coating is controlled by adjusting the nip pressure between the rolls, the circumferential speeds of each roll, and the solids content in the coating color. Therefore, the present inventors considered that an increase in the coating weight could solve the above-mentioned problems, and studied the nip pressure between rolls, the circumferential speeds and the solids contents in the coating color. In the case where the nip pressure was lowered to enlarge the gap between rolls, the coating weight was increased, but an undesirable ring-form pattern was produced in the coating. In the case where circumferential speeds were differentiated, the feeling of the coated surface worsened. It was thus found that the coating weight may be only slightly controlled in practice by differentiating the nip pressure or circumferential speeds. Therefore, control of the coating weight is mainly a function of the solids content in the color. To obtain coatings having high coating weights, the solids content of the coating color should be increased. However, if the solids content is increased using the materials used in conventional transfer roll coating colors, the viscosity of the color is also increased, thereby producing a split pattern on the applicator roll where the coating is applied. The said pattern not only appears on the coated surface to damage the feel of the coated surface, but also produces during the coating process boiling of the coating, gum-up and scattering of color mists, by which some of the advantages of transfer roll coating, namely, wide webs, high coating speed and stable operation on the machine, are lost.

By further study, the present inventors found that if the solids content is about 58 weight % or higher, and the viscosity of the color at the said solids content is about 1,500 cps or less determined at 60 rpm by using a No. 4 rotor of a Brookfield™ viscometer, transfer roll coating can be carried out to give a highly glossy and smooth coated surface under low pressure calendering conditions without affecting the advantages of the transfer roll coating process, namely, high speed and stable runnability on the machine. Furthermore, use of such coating colors provides coated papers with excellent printing quality, comparable to that obtained by the blade coating method. Furthermore, we found that a coating color having a solids content of about 58 weight % or higher, and a viscosity determined at 60 rpm by using the No. 4 rotor of a Brookfield™ viscometer of 1,500 cps or less, can be obtained by use of a low viscosity adhesive, and that a coated paper having both good feel and appearance of the coated surface can be obtained using this coating color to complete the present invention.

SUMMARY OF THE INVENTION

An object of the present invention is to provide a transfer roll coating color comprising a pigment and an adhesive as main components, characterized in that the solids content of the color is about 58 weight % or higher, and the viscosity of the color as determined at 60 rpm by using a No. 4 rotor of a Brookfield™ viscometer is about 1,500 cps or less.

Another object of the present invention is to provide a transfer roll coating color comprising a pigment and an adhesive as main components, wherein the adhesive contains a starch adhesive and the said starch adhesive is a low viscosity starch adhesive having a viscosity less than about 1600 cps determined at a solids content of about 30 weight % and a temperature of about 50° C. at 60 rpm by using a No. 4 rotor of a Brookfield™ viscometer.

Another object of the present invention is to provide a coated paper obtained by a transfer roll coating process of a coating color comprising a pigment and an adhesive as main components, wherein the solids content of the coating color is about 58 weight % or higher and the viscosity of the color as determined at 60 rpm by using a No. 4 rotor of a Brookfield™ viscometer is about 1,500 cps or less.

Another object of the present invention is to provide a process for making a coated paper comprising providing a coating color comprising a pigment and a low viscosity starch adhesive as main components, wherein the solids content of the coating color is about 58% by weight or higher and the viscosity of the color as determined at 60 rpm by using a No. 4 rotor of a Brookfield™ viscometer is about 1500 cps or less; and applying said coating color to paper by transfer roll coating.

These and other objects will become apparent by the following description.

DETAILED DESCRIPTION OF THE INVENTION

The adhesive used in the process and coating color of the present invention preferably is a water-soluble adhesive which can provide a high solids content without increasing viscosity when mixed with a pigment, and has sufficient adhering strength for the pigment. By studying the properties of the coating color and properties of the coated surface when being transfer roll coated, we found that a starch adhesive having a viscosity of less than about 1600 cps (as measured with a Brookfield™ viscometer, 60 rpm, 50° C.; hereinafter, the viscosity of the starch adhesive is determined under the said conditions) at a solids content in the adhesive of about 30 weight % is preferably used in the present invention. The viscosity of the preferred starch adhesive is quite low, since the viscosity of conventional starch adhesives at a solids content of 30 weight % typically is at least 3,000 cps, and in many cases 10,000 cps or higher. For use in the present invention, low viscosity starch adhesives include denatured starches such as ethyletherized starch, hydroxy ethyletherized starch and low viscosity oxidized starch, as well as starch-latex copolymers. To maximize the strength of the coated surface and printing gloss, the low viscosity starch adhesive is preferably used together with other adhesives, particularly with latex adhesives having relatively low viscosity and high adhering strength. The amount of adhesive used varies according to the type of adhesive and the type of the pigment used, as well as the desired qualities of the coated paper. It is important that the viscosity of the obtained coating color at a solids content of about 58 weight % is 1,500 cps or less.

Generally, paper coatings can be applied by transfer roll coating even if the viscosity of the color is low. For example, a sizing coating can be applied by transfer roll coating where the viscosity is from about 10 cps to about 100 cps. The reason why the sizing coating may be applied at such a low color viscosity is that the object of the sizing liquid coating is to increase the internal strength and surface strength of the paper. The inside strength of the paper is not increased unless the sizing liquid permeates into the inside of the base paper, which is best accomplished when the viscosity of the sizing liquid is low. Sizing coatings typically are not pigmented. However, in the case of a pigmented or color coating, if the viscosity of the coating is too low, the amount of the coating color permeating into the base paper is increased, so that the color cannot remain on the surface of the base paper and the surface coating distribution deteriorates. As a result, the smoothness of the paper is inferior, and the gloss of the paper and printability also deteriorates. Thus, the coating color according to the present invention preferably has a higher viscosity than that of the sizing used in the clear coating, and is applied at a viscosity so as not to produce a roll pattern, such as a split pattern. For this purpose, a pigmented coating having a viscosity in the range of from about 100 cps to about 1500 cps is preferred. The effect of the viscosity of the starch adhesive on the viscosity of the color is considerable, thus, the viscosity of the color may be varied considerably by adjusting the viscosity of the starch adhesive. The viscosity of the starch adhesive used in the said color is preferably in the range of from about 200 cps to below 1600 cps, more preferably from about 200 to 1520 cps.

Methods of making pigmented coatings are well known. Generally, the pigment is dispersed in a pigment dispersion at a concentration of about 70%, and the starch is formulated in a binder having a starch concentration of about 35%. The preferred concentration of latex binder is about 50%. The pigment dispersion and binder(s) then are mixed to prepare the final coating color. Suitable solids content for each material is limited. For example, if a pigment dispersion having a concentration of greater than about 80% is used, then there may be a tendency in the final color to exhibit undesirable properties, such as undispersed pigment materials. Furthermore, if the starch is cooked at a concentration higher than about 35% by weight, the viscosity may be increased too much, which cannot provide a uniform starch solution. Therefore, it may be difficult to adjust the final solids of the coating color to 70% or higher. Concentrations of from about 58% to about 70% solids are practical for the present transfer roll coating colors. Generally, when used together (admixed) with a latex, low viscosity denatured starch is preferably used in the coating color in an amount of about 1–15 weight % based on the pigment. Even at about 3–9 weight %, the required properties of the coating color and the desired qualities of the coated paper can be obtained. Where a starch-latex copolymer is used, it can be used alone (that is, not admixed with a separate latex binder), and is preferably used in an amount of about 20–50 weight % based on the pigment in the coating color.

Pigments which can be used in the present invention are not particularly limited, provided that the aspect ratio is small, and can be selected from pigments conventionally used for transfer roll coating colors. Two or more kinds of pigments may be used in admixture as required to obtain the desired qualities of the coated surface. If the aspect ratio is increased, the surface covering property becomes better, but the flowability of the coating color decreases to produce a split pattern, such as sprinkle-shading on the applicator roll when coated. An even and smooth coated surface is difficult to obtain with the use of a pigment with a large aspect ratio. If the average pigment size is too large, the viscosity of the color becomes lower, but the evenness and the smoothness of the coated surface may be adversely affected. If the average pigment size is too small, the viscosity of the coating color increases to produce a split pattern, such as orange peel or aventurine appearance, on an applicator roll upon transfer roll coating, by which an even and smooth coated surface is not obtained. Therefore, it is necessary to select a pigment with an appropriate aspect ratio and average pigment size. For this purpose, kaolinite clay or talc, which are conventionally used as coating pigments, cannot be used alone, because the average aspect ratio of these is large, e.g., about 20 or 30. An evenly coated paper with good printability can be obtained using low aspect ratio pigments, even if the pigments have small pigment sizes.

Pigments suitable for use according to the present invention include ground calcium carbonate, precipitated calcium carbonate, calcium sulfite, pyrophilite and plastic pigments, wherein the aspect ratio is about 10 or lower, and the average pigment size is about 0.1–5 $\mu$m. Calcium carbonate having an average aspect ratio of about 5 or lower, more preferably 3 or lower, and an average pigment size of about 0.5–2 $\mu$m is preferred. Other pigments which may be used with the calcium carbonate preferably have a low aspect ratio. An organic pigment can be used. Where higher gloss and opacity are desired in the coated surface, a pigment having a relatively large aspect ratio, such as kaolin, may be used unless the characteristics of the transfer roll coating are adversely affected. In such cases, the total average aspect ratio of the pigments preferably is about 10 or lower. In the case of a mixture of pigments, calcium carbonate is preferably used in an amount of about 30 weight % or higher, more preferably 40 weight % or higher, based on the total pigment amount.

The pigment dispersion and the adhesive are mixed, and additives such as a water-proofing agent, an anti-foaming agent, a dispersant, a preservative, a coloring agent and a parting agent may be added, if desired, in an amount of about 0.1–2 weight %, to provide the final coating color. The thus obtained color preferably has a viscosity of about 1,500 cps or less and a solids concentration of about 58 weight % or higher.

In the transfer roll coating process, the coating color is supplied by a color supplying means and is transferred via a metering means and, optionally, a smoothing means, to an applicator roll, and then the color on the roll is transferred against a support at a positive rotation. The color supplying means, the metering means and the smoothing means are basically constituted by multiple rolls positively rotating against the applicator roll. However, where higher metering or smoothing is desired, a reversible rotating roll, rod, blade or an air stream may be arranged in a reverse direction.

The transfer roll coating process of the present invention is characterized by applying the supplied coating colors to a supply roll, and if required, metering the amount of the coating color by means of a metering roll and/or smoothing the coating color by means of a smoothing roll, then transferring the coating color to an applicator roll followed by transferring the color on the applicator roll to the paper web by regular rotation. The supply, metering and smoothing functions are fundamentally performed by multiple regularly (forward) rotating rolls. However, for highly improved metering or smoothing, reverse rotation of a roll or a rod, or by a reversely attached blade or air may be applied used in place of the metering or smoothing roll. The coating colors of the present invention can be applied smoothly by those methods without any trouble.

Transfer roll coating includes coating processes using a gate roll coater and/or metering size press coater. The composition of the coating colors prepared by the present invention can be advantageously applied by these coaters. In the gate roll coater, two gate rolls are arranged to give a predetermined gap so as to supply the desirable amount of coating color to the applicator roll and adjusting the relative rolling speed to a desirable rate to meter the amount of coating color. The metered color is passed through between the gate rolls and split between the two rolls. The color is then spread along the transfer or applicator roll and onto the web. When one wishes to use a metering size press coater, the coating color applied onto a transfer roll and metered with a rod or a blade then coated onto a web by the transfer roll.

The coating of paper according to the process of the present invention preferably is carried out by setting two gate rolls at a specified distance in order to obtain the desired coated amount (i.e., coating weight), and controlling the relative speeds of the rolls. The color passes through the gate rolls to split the surface of the rolls, by which half of the color is transferred along the transfer rolls to the webs, and the remaining half of the color is returned to the color tank. When a coating color according to the present invention is used, a high coating weight of about 5 g/m$^2$ or more, which cannot be obtained by transfer roll coating using conventional starch adhesive coatings, can be obtained without adversely affecting the high speed property of the transfer roll coating process. A coating weight of about 5 g/m$^2$ or more provides paper having a coated surface with high smoothness, high gloss and good printability. The coated amount (coating weight) per side is preferably about 5–15 g/m$^2$, more preferably about 6–12 g/m$^2$.

Using the transfer roll coating color and process according to the present invention, the coating weight on the paper can be increased without producing any unevenness of the coated surface due to the transfer roll coating process, and the coating process can be run at high coating speeds, e.g., from about 600 or above. Preferred coating speeds are in the range of from about 600 m/min. to about 1500 m/min., more preferably between about 1000 m/min. to about 1500 m/min. Additionally, the coated paper obtained using the present coating color and transfer roll coating process achieves high smoothness and high gloss under low calendering conditions, and the resulting paper has high opacity, stiffness and printability. More particularly, excellent printing gloss with no print mottle can be achieved, resulting in a coated paper with high printability, comparable to those obtained by blade coating. Therefore, a high-grade printing paper can be obtained using the transfer roll coating method, which hitherto has been used only to produce a low-grade printing paper, which is an unexpected and surprising effect. Furthermore, a coating having superior covering properties can be obtained by high speed, stable coating on machine, therefore the present coating colors and process are excellent for undercoating in the course of multi-layer coating on machine. The reason why coated papers with high gloss, high smoothness and high printability can be obtained by using the transfer roll coating color and process according to the present invention is not clear, but can be considered as follows.

The coating color according to the present invention is superior in flowability because the viscosity is low in spite of the high solids content, so that an even coating can be obtained by forming an evenly coated film at a roll distance of the transfer rolls. Also, high coating weights, such as about 5 g/m$^2$ or more per side, can be obtained by controlling the roll distance and circumference due to the high solids content of the color. Furthermore, the high solids content of the color reduces permeation of the liquid component containing the binder into the base paper thereby forming a bulky coated layer. Opacity is increased, and any stripy unevenness of the coating surface characteristic of transfer roll coating can be corrected by low pressure calendering treatment, to give high gloss and smoothness to the final coating. Furthermore, a porous coating layer can be formed by the high solids color, to compensate for a decrease of ink set due to the increased coating weight, as well as to provide a coated paper with superior printability because stiffness is increased.

Additionally, since the color according to the present invention has a viscosity range suitable for transfer roll coating, there is no boiling of the color, or color mists formed during coating process. Since the solids content is high, the absolute water content is less than that of a low solids content color, resulting in less contamination of the lead-out roll, expander roll and after dryer just after coating, and less water permeating into the base paper. Thus, the drying load becomes lighter, so that high speed coating can be carried out in spite of increased coated amounts.

DESCRIPTION OF THE PREFERRED EMBODIMENTS

The present invention is illustrated in more detail by the following examples and comparative examples, which are not intended to limit the invention.

First, a method for formulating an adhesive solution is described and then a method for formulating a transfer roll coating color and preparation of coated papers are described.

In the following examples, parts and % are by weight unless otherwise described. Furthermore, blending parts in tables are all based on solids.

Formulating an adhesive solution

Water was added to an adhesive to adjust the solids content to 30%, stirred and dissolved while keeping the temperature at 95 ° C. or higher. After being dissolved, the temperature was adjusted to 50 ° C., and the viscosity was determined at 60 rpm using a Brookfield™ viscometer.

Examples of low viscosity starch adhesives (1)–(3) and conventional starch adhesives (1)–(2), as well as the determined results of the viscosity, are shown in Table 1.

TABLE 1

| | low viscosity starch adhesive | | | Conventional starch adhesive | |
|---|---|---|---|---|---|
| | (1) hydroxy ethyl etherized starch | (2) low viscosity oxidized starch | (3) starch latex-containing copolymer | (1) oxidized starch | (2) phosphoric esterized starch |
| Viscosity 60 rpm (cps) | 992 | 1520 | 570 | 10000< | 3860 |

Formulating a transfer roll coating color 0.1 parts of a dispersant and 0.04 parts of sodium hydroxide were added to a specified blended pigment and then dispersed in water by means of a Serie™ dispersing device, to formulate a pigment slurry with a solids content of 73%. Then, the above-described formulated adhesive solution and a styrene-butadiene (SB) latex having a solids content of 50% were added. A lubricant and a water-proofing agent also were added, and water was added, to adjust the formulation to the target concentration, and make the coating color.

The pigment used in the following examples and comparative examples was ground calcium carbonate with an average aspect ratio of 2-6.

Preparation of a coated paper

The gap between the rolls and the circumferential speed of a transfer roll coater were adjusted to give a desired coating weight. A fine base paper 64 g/m$^2$ was coated at a speed of 600 m/min with coating color described above. The obtained coated paper was subjected to seasoning under conditions of 20 ° C. and 65% relative humidity for a day and night, and then subjected to a calendering treatment.

EXAMPLES 1–2, COMPARATIVE EXAMPLES 1–2

Coating colors of Examples 1–2 and Comparative examples 1–2 were obtained according to the above-mentioned formulating method using the blends of pigments and adhesives shown in Table 2. In addition, coated papers were prepared according to the above-mentioned preparation method of coated paper for each color. The viscosity of the colors, smoothness of the coated paper and printability (gloss, print mottle), were determined or evaluated by the following determination and evaluation methods, and are shown in Table 2.

Viscosity of the color

The viscosity of a color formulated as described above was determined at room temperature by means of a Brookfield™ viscometer at a rotation of 60 rpm.

Unevenness of coating surface

The unevenness of the surface of the coating on the coated paper was evaluated visually, and were ranked as follows:

| | |
|---|---|
| ◎ | Unevenness of coating surface was not observed at all. |
| ○ | Unevenness of coating surface was hardly observed. |
| Δ | Unevenness of coating surface was slightly observed. |
| x | Unevenness of coating surface was clearly observed. |
| xx | Unevenness of coating surface was severe and spotty. |

Smoothness

Smoothness in the coating surface of the coated paper was determined by means of a Oken-siki™ smoothness factor.

Printing gloss

Printing was carried out with a RI-II™ type printing tester by using 0.4 cc of ink (tradename: TK MARK-cyan, available from Toyo Ink Co., Ltd.) on the coating surface of the coated paper, and after seasoning for a day and night, 75° gloss was determined by means of a glossmeter available from Murakami Shikisai Kenkyusho.

Print-mottle

Printing was carried out with a RI-II™ type printing tester by using 0.4 cc of ink (tradename: TK MARK-cyan, available from Toyo Ink Co., Ltd.) on the coating surface of the coated paper, and after seasoning for a day and night, print mottle was evaluated visually by a five point method (5 good-1 bad).

TABLE 2

| | Examples | | Comparative Examples | |
|---|---|---|---|---|
| | 2 | 2 | 1 | 1 |
| Coating weight g/m$^2$ | 10 | 10 | 10 | 10 |
| kaolin, parts | 54 | | 54 | 45 |

TABLE 2-continued

| | Examples | | Comparative Examples | |
|---|---|---|---|---|
| | 2 | 2 | 1 | 1 |
| average aspect ratio | 11 | | 11 | 10.4 |
| Calcium carbonate, parts | 46 | | 46 | 55 |
| average aspect ratio | 2.3 | | 2.3 | 2.5 |
| latex parts | 14 | | 14 | 14 |
| starch, parts | 5 | | 5 | 5 |
| starch used | low viscosity starch adhesive (1) | low viscosity starch adhesive (2) | conventional starch adhesive (1) | conventional starch adhesive (1) |
| solids content % | 62 | 62 | 62 | 61 |
| viscosity 60 rpm cps | 758 | 892 | 1749 | 1524 |
| unevenness of coating surface | ◎ | ◎ | X | X |
| smoothness sec | 77 | 74 | 73 | 57 |
| printing gloss % | 55.0 | 54.0 | 51.2 | 50.2 |
| print mottle | 5 | 4.5 | 2 | 2.5 |

calender linear pressure: 100 Kg/cm

As is apparent from these examples and comparative examples, the coated papers obtained by transfer roll coating using the coating color according to the present invention were excellent in printability, particularly against print mottle. The color in the comparative examples could be coated in 10 g/m$^2$ on one side, but unevenness of coating surface (split pattern) specific to the transfer roll coating process was produced, and print mottle was also increased. In addition, boiling was produced and runnability during coating was inferior since the viscosity of the color was high.

Colors were formulated with the blending ratio of pigments and adhesives shown in Table 3, and then coated papers with coating weights of 5 g/m$^2$ and 7.5 g/m$^2$ on one side were prepared as to each color.

Viscosity of the colors, the smoothness of coated papers and printability (gloss, print mottle) were determined or evaluated by the determination and evaluation methods similar to those in Example 1, and the results are shown in Table 3.

TABLE 3

| | Examples | | Comparative Examples | | | | | |
|---|---|---|---|---|---|---|---|---|
| | 3 | 4 | 3 | 4 | 5 | 6 | 7 | 8 |
| Coating weight g/m | 4.5 | 7.5 | 5.0 | 7.5 | 5.0 | 7.5 | 5.0 | 7.5 |
| kaolin, parts | 52 | | 85 | | 71 | | 71 | |
| average aspect ratio | 10.9 | | 12.8 | | 10 | | 10.5 | |
| calcium carbonate, parts | 48 | | 15 | | 29 | | 29 | |
| average aspect ratio | 2.4 | | 2 | | 2.3 | | 1.7 | |
| latex, parts | 14 | | 14 | | 14 | | 14 | |
| starch, parts | 5 | | 7 | | 13 | | 7 | |
| starch used | low viscosity starch adhesive (1) | | low viscosity starch adhesive (1) | | conventional starch adhesive (1) | | conventional starch adhesive (2) | |
| solids content % | 62 | | 57 | | 54 | | 59 | |
| viscosity 60 rpm cps | 720 | | 2130 | | 2260 | | 2060 | |
| unevenness of coating surface | ○ | ◎ | X | XX | X | XX | Δ | XX |
| smoothness sec | 35 | 44 | 37 | — | 25 | — | 36 | — |
| printing gloss % | 34.6 | 46 | 34.3 | — | 34.4 | — | 34.1 | — |
| print mottle | 4 | 5 | 1.5 | 1 | 1.5 | 1 | 2.5 | 1 |

calender linear pressure: 60 Kg/cm

As is apparent from these examples, coated papers made with the coating colors according to the present invention were excellent in printability, particularly against print mottle. In comparative examples 4, 6 and 8, smoothness and printing gloss could not be determined since unevenness of the coating surface occurred. Furthermore, in the comparative examples, stripy print mottle characteristic of the transfer roll coating process was observed. Particularly, in comparative examples 3 and 5, stripy unevenness of the coating surface was severe and print mottle was remarkable.

EXAMPLES 5–6, COMPARATIVE EXAMPLES 9–14

Colors were formulated with the blending ratio of pigments and adhesives shown in Table 4, coated papers were prepared for each color and then subjected to a calendering treatment under high linear pressure.

Viscosity of color, smoothness of coated papers and printability (gloss, print mottle) were determined or evaluated by the determination and evaluation methods similar to those in Example 1, and the results are shown in Table 4.

TABLE 4

| | Examples | | Comparative Examples | | | | | |
|---|---|---|---|---|---|---|---|---|
| | 5 | 6 | 9 | 10 | 11 | 12 | 13 | 14 |
| Coating weight g/m$^2$ | 4.5 | 7.5 | 5.0 | 7.5 | 5.0 | 7.5 | 5.0 | 7.5 |
| Kaolin, parts | 52 | | 85 | | 71 | | 71 | |
| average aspect ratio | 10.9 | | 12.8 | | 10 | | 10.5 | |
| calcium carbonate, parts | 48 | | 15 | | 29 | | 29 | |
| average aspect ratio | 2.4 | | 2 | | 2.3 | | 1.7 | |
| latex, parts | 14 | | 14 | | 14 | | 14 | |
| starch, parts | 5 | | 7 | | 13 | | 7 | |
| starch used | low viscosity starch adhesive (1) | | low viscosity starch adhesive (1) | | conventional starch adhesive (1) | | conventional starch adhesive (2) | |
| solids content % | 62 | | 57 | | 54 | | 59 | |
| viscosity 60 rpm cps | 720 | | 2130 | | 2260 | | 2060 | |
| unevenness of coating surface | ○ | ◎ | X | XX | X | XX | Δ | XX |
| smoothness sec | 150 | 207 | 144 | — | 120 | — | 135 | — |
| printing gloss % | 39.2 | 48.7 | 39.2 | — | 38.5 | — | 38.9 | — |
| print mottle | 5 | 5 | 1.5 | 1 | 1.5 | 1 | 1.5 | 1 |

calender linear pressure: 100 Kg/cm

As is apparent from these examples, the coated papers made using the coating color applied by transfer roll coating according to the present invention were excellent in printability, particularly against print mottle, even after being subjected to calendering treatment under high linear pressure. On the contrary, in comparative examples 4, 6 and 8, smoothness and printing gloss could not be determined since unevenness of the coating surface occurred. Furthermore, in the comparative examples, stripy print mottle characteristic of the transfer roll coating process was observed, and could not be improved after being subjected to calendering treatment under high linear pressure, and were inferior in printability. Particularly, in comparative examples 3 and 5, stripy unevenness of the coating surface was severe and print mottle was marked.

EXAMPLES 7–9, COMPARATIVE EXAMPLES 15–20

In examples 7–9 and comparative examples 15–20, colors were formulated with the blending ratio of pigments and adhesives shown in Table 5, and papers were transfer roll coated with the colors at a coating speed of 1000 m/min. by means of a practical on-machine coater, and subjected to a soft calendering treatment under a linear pressure of 75 kg/cm. Comparative examples 18–20 were commercially available products coated according to a blade coating method having the same grades as in the examples.

Viscosity of colors, smoothness of the coated papers and printability (gloss, print mottle) were determined or evaluated by the determination and evaluation methods similar to those in Example 1, and results are shown in Table 5.

TABLE 5

| | Examples | | | Comparative Examples | | | | | |
|---|---|---|---|---|---|---|---|---|---|
| | 7 | 8 | 9 | 15 | 16 | 17 | 18 | 19 | 20 |
| Coating method | Roll | Roll | Roll | Roll | Roll | Roll | Blade | Blade | Blade |
| Coating weight (g/m$^2$) | 8 | 7 | 7 | 5 | 4.5 | 4 | — | — | — |
| kaolin, parts | 52.6 | 52.6 | 46.4 | 85 | 76.5 | 71 | — | — | — |
| average aspect ratio | 10.5 | 10.5 | 10.5 | 12.1 | 12.3 | 9.7 | — | — | — |
| calcium carbonate, parts | 47.4 | 47.6 | 53.6 | 15 | 23.5 | 29 | — | — | — |
| average aspect ratio | 2.4 | 2.4 | 2.5 | 2 | 2.4 | 2.3 | — | — | — |
| latex, parts | 14 | 14 | 14.5 | 16 | 15 | 14 | — | — | — |
| starch, parts | 5 | 7 | 5 | 11 | 10 | 13 | — | — | — |
| starch used | low viscosity starch adhesive (1) | | | conventional starch adhesive (1) | | | — | — | — |

TABLE 5-continued

| | Examples | | | Comparative Examples | | | | | |
|---|---|---|---|---|---|---|---|---|---|
| | 7 | 8 | 9 | 15 | 16 | 17 | 18 | 19 | 20 |
| solids content % | 61 | 62 | 62 | 55 | 55 | 53 | — | — | — |
| viscosity 60 rpm cps | 680 | 730 | 700 | 425 | 420 | 450 | — | — | — |
| unevenness of coating surface | ◎ | ○ | ◎ | X | X | Δ | ○ | ◎ | ○ |
| smoothness sec | 226 | 209 | 210 | 152 | 187 | 194 | 160 | 142 | 103 |
| printing gloss % | 55.2 | 53.0 | 56.3 | 43.0 | 45.1 | 48.3 | 49.9 | 54.6 | 41.9 |
| print mottle | 5 | 4 | 4.5 | 2 | 2 | 3.5 | 3.5 | 4.5 | 4 |

calendar linear pressure: 75 Kg/cm

As is apparent from these examples, the coated papers made using the transfer roll coating colors according to the present invention were excellent in printability, particularly against print mottle. In addition, the papers according to the present invention had equal or higher printability when compared with commercially available products obtained by blade coating, which typically are superior to those of typical transfer roll coated products. Furthermore, the papers according to the present invention could be prepared without using a separate base paper preparation procedure and coating procedure, such as must be done in conventional blade coating. Additionally, the speed of on-machine-transfer roll coating according to the present invention was equal to the speed used in blade coating, and wide web, high speed coating which surpassed blade coating could be carried out by the transfer roll coating.

EXAMPLES 10–13, COMPARATIVE EXAMPLES 21–24

Colors were formulated with the blending ratio of pigments and adhesives shown in Table 6, and coated papers with coating weights of 5 g/m$^2$ and 8 g/m$^2$ per side were prepared for each color.

Viscosity of colors, smoothness of the coated papers and printability (gloss, print mottle) were determined or evaluated by the determination and evaluation methods similar to those in Example 1, and results are shown in Table 6.

TABLE 6

| | Examples | | | | Comparative Examples | | | |
|---|---|---|---|---|---|---|---|---|
| | 10 | 11 | 12 | 13 | 21 | 22 | 23 | 24 |
| Coating weight g/m$^2$ | 5.0 | 8 | 5.0 | 8 | 5.0 | 5.0 | 8 | 5.0 |
| kaolin, parts | 46 | | | | | | | |
| average aspect ratio | 11 | | | | | | | |
| calcium carbonate, parts | 54 | | | | | | | |
| average aspect ratio | 2.5 | | | | | | | |
| latex, parts | 0 | | 14 | | 14 | | | |
| starch, parts | 30 | | 7 | | 7 | | | |
| starch used | low viscosity starch adhesive (3) | | low viscosity starch adhesive (1) | | conventional starch adhesive (1) | | | |
| solids content % | 60 | | 63 | | 56 | 62 | | 56 |
| viscosity cps | 1170 | | 1100 | | 360 | 2880 | | 540 |
| unevenness of coating surface | ○ | ◎ | ○ | ◎ | Δ | X | Δ | X |
| smoothness sec | 182 | 189 | 170 | 187 | 168 | 157 | 176 | 167 |
| printing gloss % | 35.8 | 43.4 | 35.3 | 43.9 | 30.7 | 32.9 | 40.9 | 28.9 |
| print mottle | 3.5 | 4.5 | 3.5 | 4.5 | 3 | 2.5 | 3 | 2.5 |

calender linear pressure: 120 Kg/cm

As is apparent from these examples, the papers coated by transfer roll coating using the colors according to the present invention were excellent in printability, particularly against print mottle. In Comparative examples 21 and 24, the coating weight of 8 g/m$^2$ could not be applied due to the structure of the transfer coating machine. Furthermore, in Comparative examples 22 and 23, unevenness of coating surface occurred and stripy print mottle specific to the transfer roll coating process was observed.

EXAMPLES 14–17, COMPARATIVE EXAMPLES 25–30

Colors were formulated with the blending ratio of pigments and adhesives shown in Table 7, and coated papers with coating weights of 6 g/m$^2$ and 7.5 g/m$^2$ per side were prepared for each color. Viscosity of color, smoothness of the coated papers and printability (gloss, print mottle) were determined or evaluated by the determination and evaluation methods similar to those in Example 1, and the results are shown in Table 7.

TABLE 7

| | Examples | | | | Comparative Examples | | | | | |
|---|---|---|---|---|---|---|---|---|---|---|
| | 14 | 15 | 16 | 17 | 25 | 26 | 27 | 28 | 29 | 30 |
| Coating weight g/m$^2$ | 5 | 7.5 | 5 | 7.5 | 5 | 7.5 | 5 | 7.5 | 5 | 7.5 |
| calcium carbonate, parts | | | | | 100 | | | | | |
| average aspect ratio | | | | | 2 | | | | | |
| starch, parts starch used | 5 | | 10 | | 20 | | 30 | | 30 | |
| | | | low viscosity starch adhesive (1) | | | | | | conventional starch adhesive (1) | |
| latex, parts | 13 | | 10 | | 5 | | 0 | | 0 | |
| solids content % | 61 | | 60 | | 57 | | 54 | | 50 | |
| viscosity cps | 684 | | 1450 | | 2420 | | 3730 | | 3230 | |
| unevenness of coating surface | ◎ | ◎ | ○ | ◎ | Δ | Δ | X | X | XX | XX |
| smoothness sec | 146 | 149 | 141 | 144 | 123 | 132 | 111 | 115 | 113 | 116 |
| printing gloss % | 47.2 | 47.2 | 44.2 | 45.1 | 36.8 | 42.4 | 33.3 | 40.5 | 32.4 | 35.5 |
| print mottle | 4.5 | 5 | 4 | 4.5 | 2.5 | 3 | 2 | 2 | 1.5 | 1.5 |

calender linear pressure: 100 Kg/cm

As is apparent from these examples, the coated papers coated by transfer roll coating using the colors according to the present invention were excellent in printability, particularly against print mottle. In Comparative examples 25–30, unevenness of the coating surface occurred and stripy print mottle specific to the transfer roll coating process was observed.

EXAMPLES 18–22, COMPARATIVE EXAMPLES 31–33

Colors were formulated with the blending ratios of pigments and adhesives shown in Table 8. In Examples 18–20 and Comparative examples 31–32, the colors were coated onto pure coating base paper of 50 g/m$^2$ weight with a pilot coater by transfer roll coating at a rate of 1200 m/min., and treated with soft calender linear pressure of 40 kg/cm. In examples 21–22 and comparative Example 33, the colors were coated onto pure coating base paper of 64 g/m$^2$ weight with a pilot coater by transfer roll coating at a rate of 1500 m/min. and treated with soft calender linear pressure of 110 kg/cm.

The viscosity of the colors, the smoothness of the coating base and the quality of printing such as gloss and mottle were evaluated as described in Example 1, and the results are shown in Table 8.

TABLE 8

| | Examples | | | | | Comparative Examples | | |
|---|---|---|---|---|---|---|---|---|
| | 18 | 19 | 20 | 21 | 22 | 31 | 32 | 32 |
| Coating weight g/m$^2$ | 8 | 10 | 7.5 | 9 | 8.0 | 7 | 5 | 7 |
| kaolin, parts | 46 | 46 | 46 | 46 | 46 | 85 | 85 | 85 |
| average aspect ratio | 10.4 | 10.4 | 10.4 | 10.4 | 10.4 | 12.8 | 12.8 | 12.8 |
| calcium carbonate parts | 54 | 54 | 54 | 54 | 54 | 15 | 15 | 15 |
| average aspect ratio | 2.5 | 2.5 | 2.5 | 2.5 | 2.5 | 2 | 2 | 2 |
| latex, parts | 14 | 14 | 14 | 14 | 14 | 14 | 14 | 14 |
| starch, parts | 5 | 5 | 7 | 5 | 7 | 7 | 10 | 7 |
| starch used | low viscosity starch adhesive (1) | | | | | | conventional starch adhesive (1) | |
| solid content % | 58 | 60 | 58 | 59 | 59 | 61 | 55 | 60 |
| viscosity 60 rpm ops | 420 | 600 | 590 | 510 | 710 | 1760 | 410 | 2220 |
| unevenness of coating surface | ⊙ | ⊙ | ○ | ○ | ○ | Δ | X | X |
| smoothness sec | 116 | 130 | 84 | 158 | 143 | 102 | 80 | 135 |
| printing gloss % | 39.3 | 42.2 | 38.8 | 45.3 | 43.1 | 38.0 | 35.1 | 42.3 |
| print mottle | 5 | 5 | 4.5 | 4 | 4 | 3 | 2 | 1.5 |
| machine speed | 1200 | 1200 | 1200 | 1500 | 1500 | 1200 | 1200 | 1500 |
| calender linear pressure, kg/cm | 40 | 40 | 40 | 110 | 110 | 40 | 40 | 110 |

EQUIVALENTS

Those skilled in the art can easily ascertain the essential characteristics of the invention from the foregoing description, and without departing from the spirit and scope thereof, will be able to make various modifications to adapt it to various equivalent usages and conditions. Such equivalents are intended to be encompassed by the following claims.

What is claimed is:

1. A coated paper prepared by a process comprising the steps of:

(a) providing a coating color having a solids content of about 58 weight percent or greater and a viscosity of between about 100 cps and about 1500 cps, the coating color comprising:

a pigment, wherein the pigment has an average aspect ratio of about 10 or less, and an adhesive, wherein the adhesive comprises a low viscosity starch adhesive having a viscosity between about 200 cps to about 1600 cps determined at a solids content of about 30 weight percent and a temperature of about 50° C.; and (b) applying the coating color to a base paper by transfer roll coating.

2. The coated paper of claim 1 wherein the low viscosity starch adhesive comprises a blend of a low viscosity denatured starch and latex or a starch-latex copolymer.

3. The coated paper of claim 2 wherein the low viscosity denatured starch is selected from the group consisting of ethyl etherized starch, hydroxy ethyl etherized starch and low viscosity oxidized starch.

4. The coated paper of claim 1 wherein the coated paper comprises about 5 $g/m^2$ to about 15 $g/m^2$ of the coating color per side.

5. The coated paper of claim 1 wherein the pigment has an average pigment size of about 0.1 $\mu$m to about 5 $\mu$m.

6. The coated paper of claim 1 wherein the coating color is applied in step (b) at a speed of about 600 m/min or greater.

7. The coated paper of claim 1 wherein the coating color is applied in step (b) at a speed of from about 600 m/min to about 1500 m/min by transfer roll coating.

8. The coated paper of claim 1 wherein the coating color is applied in step (b) at a speed of from about 1000 m/min to about 1500 m/min by transfer roll coating.

9. The coated paper of claim 1 wherein step (b) is carried out using a gate roll coater or a metering press size coater.

10. A coated paper prepared by a process comprising the steps of:

(a) providing a coating color having a solids content of about 58 weight percent or greater and a viscosity of between about 100 cps and about 1500 cps, the coating color comprising:

a pigment, wherein the pigment has an average aspect ratio of about 10 or less and an average pigment size of about 0.1 $\mu$m to about 5 $\mu$m, and an adhesive, wherein the adhesive comprises a low viscosity starch adhesive having a viscosity between about 200 cps to about 1600 cps determined at a solids content of about 30 weight percent and a temperature of about 50° C.; and (b) applying the coating color to a base paper by transfer roll coating at a speed of about 600 m/min or greater.

11. A coated paper prepared by a process comprising the steps of:

(a) providing a coating color having a solids content of about 58 weight percent or greater and a viscosity of between about 100 cps and about 1500 cps, the coating color comprising:

a calcium carbonate, wherein the calcium carbonate has an average aspect ratio of about 5 or less and an average pigment size of about 2 $\mu$m or less, and an adhesive, wherein the adhesive comprises a low viscosity starch adhesive having a viscosity between about 200 cps to about 1600 cps determined at a solids content of about 30 weight percent and a temperature of about 50° C.; and (b) applying the coating color to a base paper by transfer roll coating at a speed of about 600 m/min or greater.

* * * * *